US006041676A

United States Patent [19]

Bettenhausen

[11] Patent Number: 6,041,676

[45] **Date of Patent: *Mar. 28, 2000**

[54] WINCH WITH LOCKING MECHANISM

[76] Inventor: Roger V. Bettenhausen, 5 Lakewood Dr., Columbus, Nebr. 68601

[ * ] Notice: This patent is subject to a terminal disclaimer.

[21] Appl. No.: 08/839,652

[22] Filed: Apr. 15, 1997

Related U.S. Application Data

[60] Continuation-in-part of application No. 08/678,184, Jul. 11, 1996, Pat. No. 5,660,084, which is a division of application No. 08/498,180, Jul. 5, 1995, abandoned.

[51] Int. Cl.[7] ..... G05G 1/00; B66D 1/00

[52] U.S. Cl. ..... 74/545; 74/526; 74/527; 74/540; 254/264

[58] Field of Search ..... 74/540, 545, 594.1; 53/556, 219; 254/264, 95, 97

[56] References Cited

U.S. PATENT DOCUMENTS

| | | | |
|---|---|---|---|
| 1,304,358 | 5/1919 | Norlund | 254/97 |
| 1,324,721 | 12/1919 | Benedict | 254/97 |
| 1,850,513 | 3/1932 | Murphy | 254/95 |
| 3,765,259 | 10/1973 | Firth | 74/354 |
| 3,934,852 | 1/1976 | Weber et al. | 74/405 X |
| 5,606,849 | 3/1997 | Bettenhausen | 53/556 |

*Primary Examiner*—Vinh T. Luong
*Attorney, Agent, or Firm*—Emrich & Dithmar

[57] ABSTRACT

A locking winch includes a rotatable shaft coupled to a bracket adapted for connection to a structure such as a trailer, truck, hoist, etc. Wrapped around the shaft is a cable, rope or chain and connected to one end of the shaft is a hand operated crank for rotating the shaft in a first direction for retracting the cable about the shaft or for rotating the shaft in a second, opposed direction for removing the cable from the shaft, with the crank movable between first and second positions on the shaft. A sprocket fixedly mounted to the bracket includes a plurality of spaced teeth disposed about the periphery thereof. A torsion spring coupled to the hand operated crank urges the crank to the first position. A locking pin attached to the hand operated crank is disposed between adjacent teeth on the periphery of the sprocket when the crank is in the first position to prevent rotation of the shaft and either withdrawal of the cable from or take-up of the cable on the rotatable shaft. When the crank is manually moved to the second position by overcoming the biasing force exerted by the torsion spring, the locking pin is removed from between adjacent teeth on the sprocket permitting rotation of the crank and shaft and allowing the cable to be either taken up on or removed from the shaft. The crank automatically returns to the first position when manual pressure is removed from the crank, returning the winch to the locked configuration.

10 Claims, 10 Drawing Sheets

WINCH WITH LOCKING MECHANISM

RELATED APPLICATION

This is a continuation-in-part application of application Ser. No. 08/678,184, filed Jul. 11, 1996, now U.S. Pat No. 5,660,084 which is a divisional application of Ser. No. 08/498,180, filed Jul. 5, 1995, abandoned.

FIELD OF THE INVENTION

This invention relates generally to a hand operated winch and is particularly directed to a lockable winch which may be easily manipulated using only one hand between a locked configuration and an unlocked configuration wherein a cable, rope or chain may be wound onto or removed from the winch.

BACKGROUND OF THE INVENTION

For shipment or storage, packages are frequently wrapped with a plastic film material so as to provide a strong and protective layer about the package. By "package" is meant here any object or article, or collection of objects or articles, which are to be wrapped such as for shipment or storage. One common approach is to position the package on a rotating platform and dispense the plastic film in engagement with the package as the package is rotated. The plastic film dispenser may be either hand-held or attached to the package wrapping apparatus.

Referring to FIGS. 1*a* and 1*b*, there are respectively shown partially cutaway and partially in phantom top plan and side elevation views of a typical prior art package wrapping apparatus 100. The wrapping apparatus 100 includes a rotating deck 102 which is disposed upon and supported by a plurality of rollers 104*a*–104*d*. The package to be wrapped is disposed on the rotating deck 102 which may also support a pallet on which the package is disposed for ease of handling the package. Each of these support rollers 104*a*–104*d* is attached to and supported by a respective bracket 106*a*–106*d*. A center, lower portion of the rotating deck 102 is positioned on and supported by a combination of a support shaft 112, bearings 116 and a race 114. The combination of rollers 104*a*–104*d* and bearings 116 allow for the free rotation of deck 102 about a generally vertical axis through shaft 112. A rotary drive arrangement 108 such as including an electric motor is typically coupled to the support shaft 112 by means of sprockets or pulleys and a chain, belt, or other suitable linkage 110.

One disadvantage of the prior art package wrapping apparatus 100 is that the tension of the wrapping material is difficult to control and thus the tightness of the wrap about the package is generally nonuniform. In addition, the rotational drive arrangement does not provide positive control over the rotating package thus necessitating the use of a brake mechanism to slow down and stop the rotating deck and package combination. Finally, the rollers 104*a*–104*d* disposed about and engaging a lower portion of the rotating deck 102 must be precisely aligned relative to one another as well as to the deck and substantially increase the cost and complexity of the wrapping apparatus.

The present invention provides a winch with a locking mechanism which is easily manipulated using only one hand between a locked mode and an unlocked mode in which a cable, rope or chain may be wound onto the winch or may be withdrawn from the winch.

OBJECTS AND SUMMARY OF THE INVENTION

Accordingly, it is an object of the present invention to provide an easily operated lockable winch of simplified, reliable construction.

It is another object of the present invention to provide a winch which is easily manipulated using only one hand between a locked mode wherein a cable connected to the winch is prevented from being either wound onto or removed from the winch and an unlocked mode for winding the cable onto or removing the cable from the winch.

Yet another object of the present invention is to provide a hand operated winch the operation of which may be changed from a locked mode to a mode in which a cable connected to the winch may be wound onto or unwound from the winch using only one hand in a single motion.

This invention contemplates a locking winch comprising a bracket; a rotatable shaft coupled to the bracket and having a cable, rope or chain disposed thereabout; a hand operated crank coupled to said shaft for rotating the shaft in a first direction for retracting the cable, rope or chain about the shaft or for rotating the shaft in a second, opposed direction for removing the cable, rope or chain from the shaft, wherein said crank is moveable between first and second positions on the shaft; biasing means for urging the crank to the first position; stop means mounted to the bracket for providing a plurality of stop members disposed about the periphery thereof; and locking means attached to the crank for engaging a stop member when the crank is in the first position for preventing rotation of the crank and shaft and removal of the cable, rope or chain from the shaft, wherein the locking means disengages the stop member when a force exerted by the biasing means on the crank is overcome and the crank is moved to the second position allowing the cable, rope or chain to be wound onto or removed from the shaft.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1A:
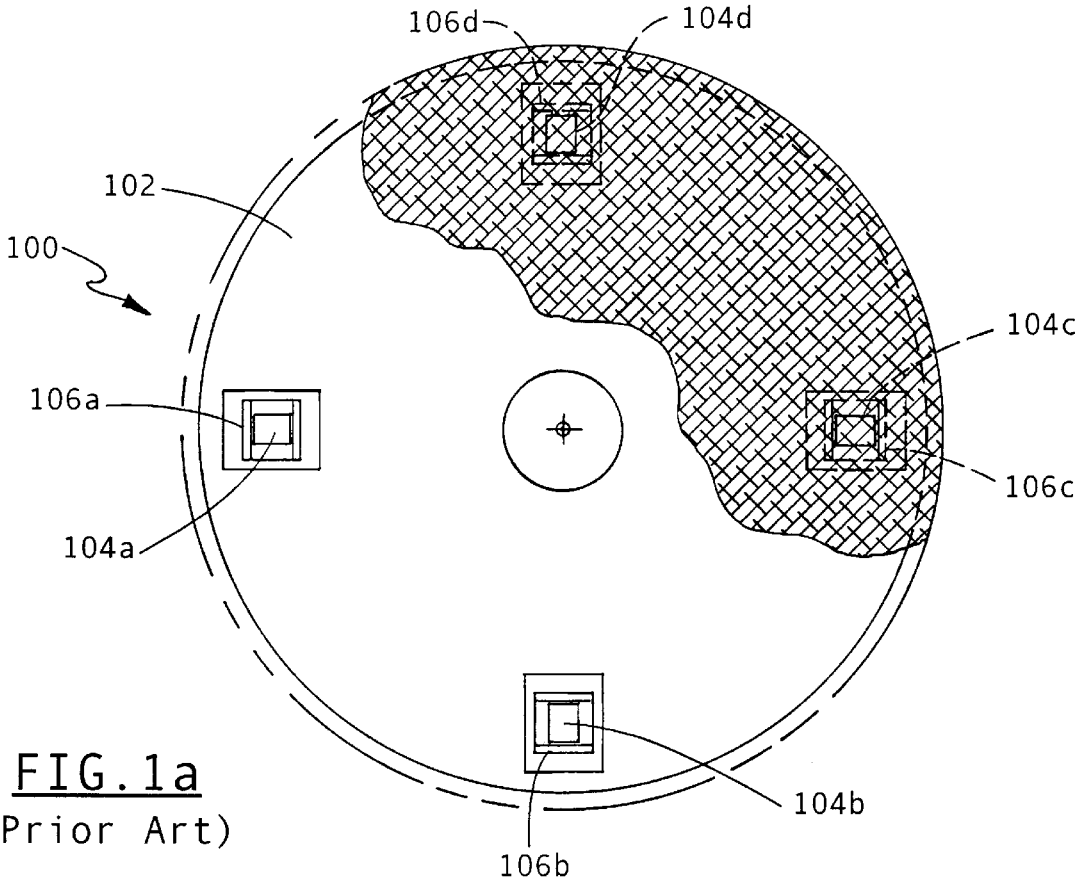
FIG.1a (Prior Art)
FIGS. 1*a* and 1*b* are respectively top plan and side elevation views shown partially in phantom and partially cutaway of a prior art package wrapping apparatus of the rotating type.
Figure 1B:
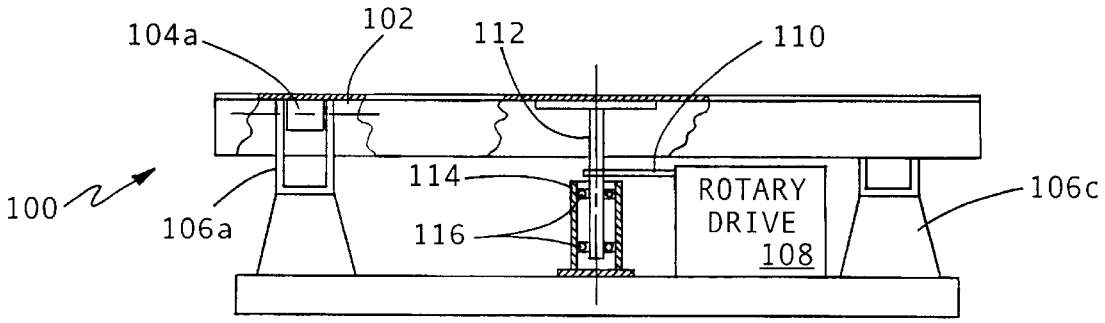
FIG.1b (Prior Art)
Figure 2:
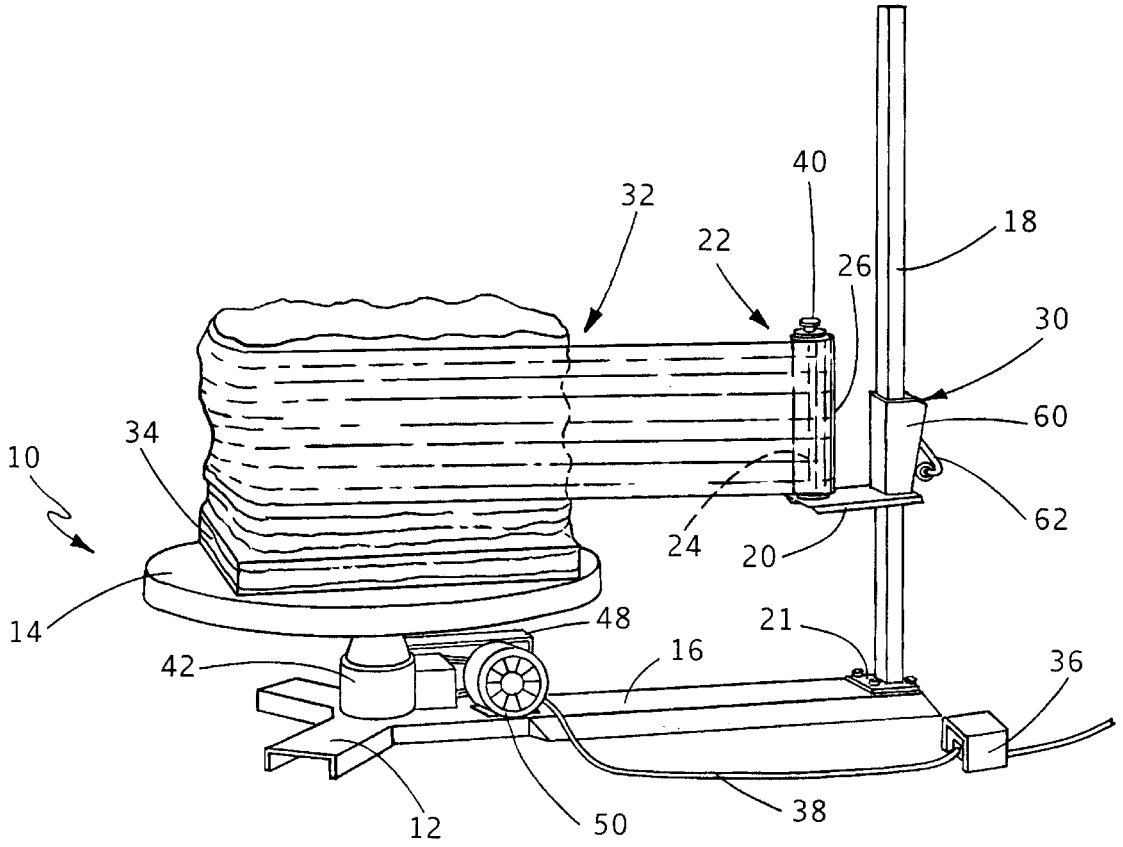
FIG. 2 is a perspective view of a package wrapping apparatus in accordance with the present invention showing a collection of objects disposed on a pallet for wrapping in a thin film wrap.
Figure 3:
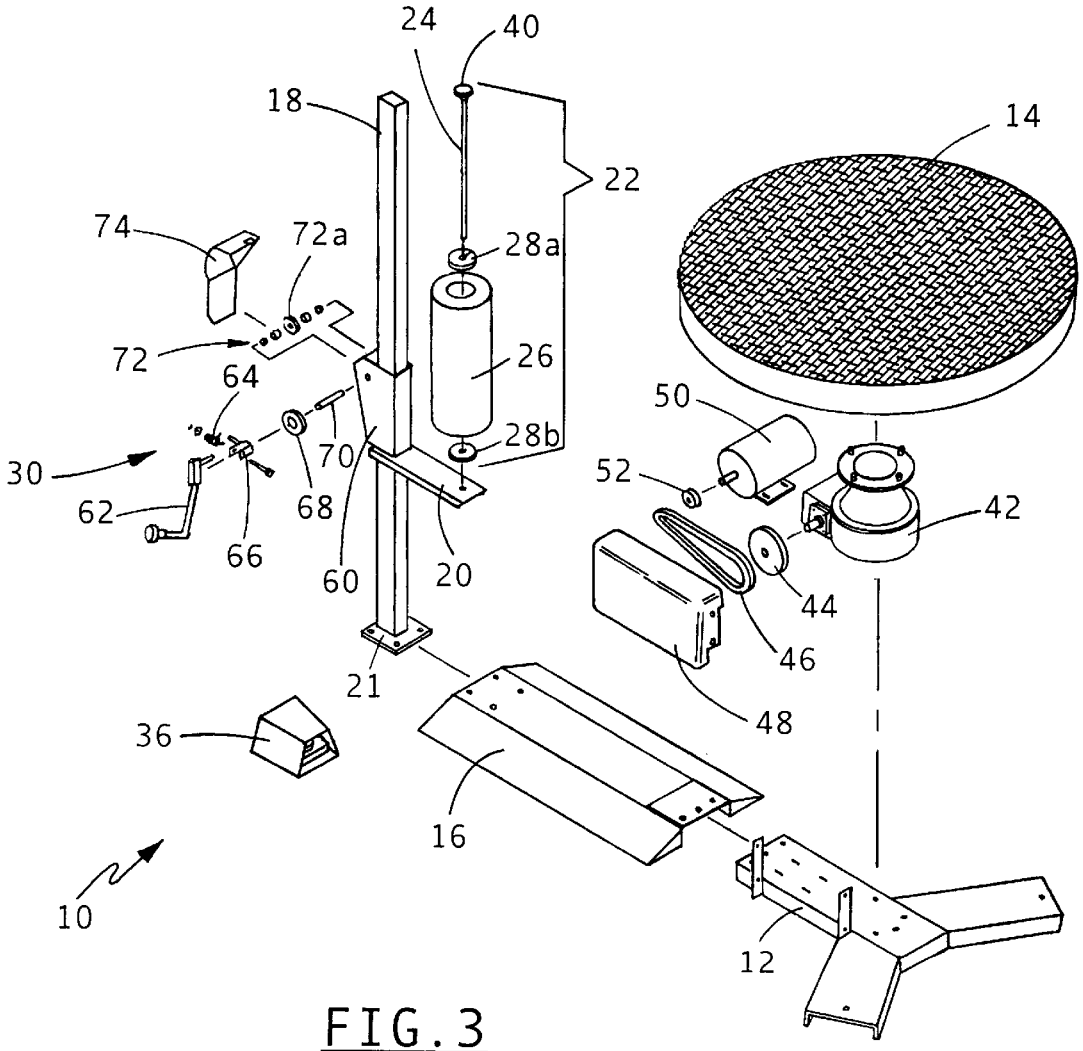
FIG. 3 is an exploded perspective view of the package wrapping apparatus of FIG. 2.

Referring to FIG. 2, there is shown a perspective view of a package wrapping apparatus 10 in accordance with the principles of the present invention. FIG. 3 is an exploded perspective view of the package wrapping apparatus 10 shown in FIG. 2.

Package wrapping apparatus 10 includes a base 12 adapted for positioning on a flat support surface and further includes a rotating deck 14 adapted to receive and support a package 32. In FIG. 2, package 32 is shown disposed on a pallet 34 for ease of handling such as by means of a forklift.

Figure 5:
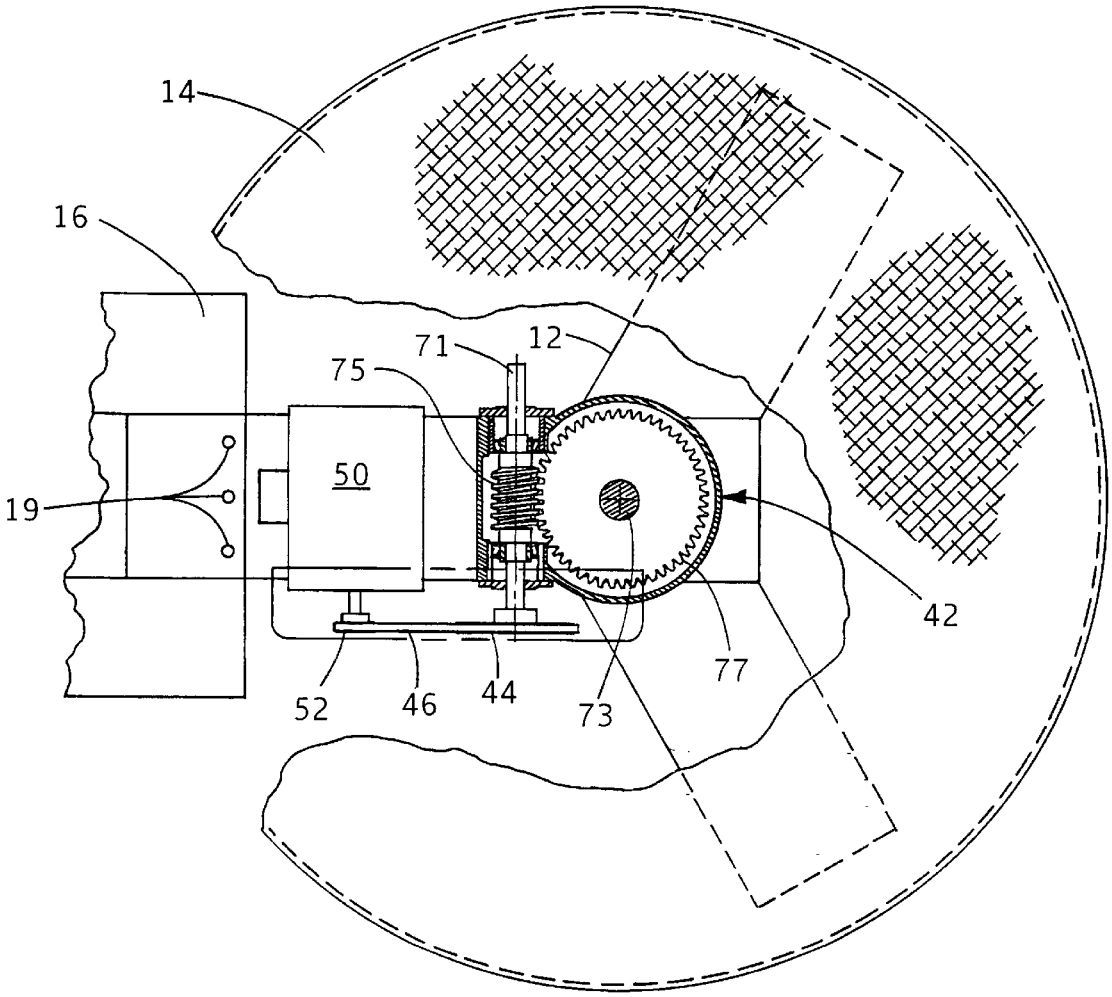
FIG. 5 is a partially cut away partial top plan view of the package wrapping apparatus of the present invention shown partially in phantom illustrating additional details of the rotational drive arrangement.

Attached to the base 12 and also disposed on the support surface is a base extension 16. Conventional coupling means such as nut and bolt combinations 19 such as shown in FIG. 5 may be used to connect base 12 with base extension 16. Attached to an upper surface of the base extension 16 by conventional means such as nut and bolt combinations (which are not shown for simplicity) is a vertical support column 18. A mounting bracket 21 disposed on the lower end of the support column 18 facilitates attaching the support column to the base extension 16. Disposed on the vertical support column 18 is the combination of a film wrap supply and tensioner 22 and a film wrap height positioner 30 which are described in detail below.

Figure 4:
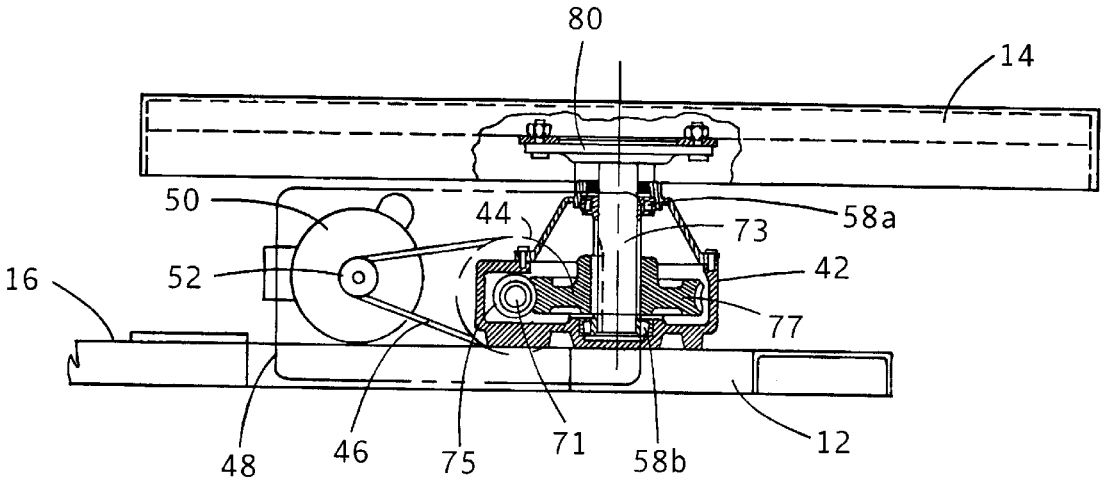
FIG. 4 is a partially cutaway side elevation view shown partially in phantom of the rotational drive arrangement for the package supporting deck in the package wrapping apparatus of the present invention.

With reference to FIGS. 2 and 3, as well as to FIGS. 4 and 5 which are respectively partially cutaway side elevation and top plan views of the rotating package positioning and support portion of the package wrapping apparatus 10, the drive arrangement for rotationally displacing the package 32 disposed on the rotating deck 14 will now be described. Fixedly mounted to an upper surface of base 12 is the combination of an electric motor 50 and a gear box 42. Electric motor 50 and gear box 42 are coupled by means of the combination of first and second pulleys 44 and 52 and an endless drive belt 46. Rotation of the output shaft of motor 50 causes a corresponding rotation of an input shaft 71 of gear box 42. A cover 48 is disposed over the pulley and endless drive belt combination. Disposed on input shaft 71 is a threaded portion 75 which is positioned so as to engage the teeth of a sprocket 77 so as to form a worm gear within gear box 42. Inserted through and fixedly attached to sprocket 77 is a generally vertically oriented output shaft 73. The upper end of output shaft 73 is coupled to a mounting bracket 80 which, in turn, is securely attached to a lower surface of the rotating deck 14. Upper and lower bearings 58*a* and 58*b* and suitable inner and outer races permit free rotation of the output shaft 73 and deck 14 about a generally vertically axis extending through the center of the output shaft. Directly connecting the rotating deck 14 to and supporting the rotating deck by means of the rotational drive unit including motor 50 and gear box 42 eliminates the outer rollers required in the prior art to support the rotating deck and allows for improved control over displacement of the deck, particularly in eliminating the need for a braking mechanism for bringing the rotating deck to a stop.

The electric motor 50 used in the present invention may be of conventional design and operation and is thus provided with an electrical lead 38 for connecting to a source of electrical power. A foot switch 36 is coupled to the electrical lead 38 for applying electrical power to and removing power from motor 50 in starting and stopping rotation of the rotating deck 14 and package 32 disposed thereon. Use of foot switch 36 frees the hands of an operator of the package wrapping apparatus 10 to perform other operations such as stabilizing the package on the rotating deck 14 or manipulating the film wrap as it is unrolled onto the package.

Figure 6A:
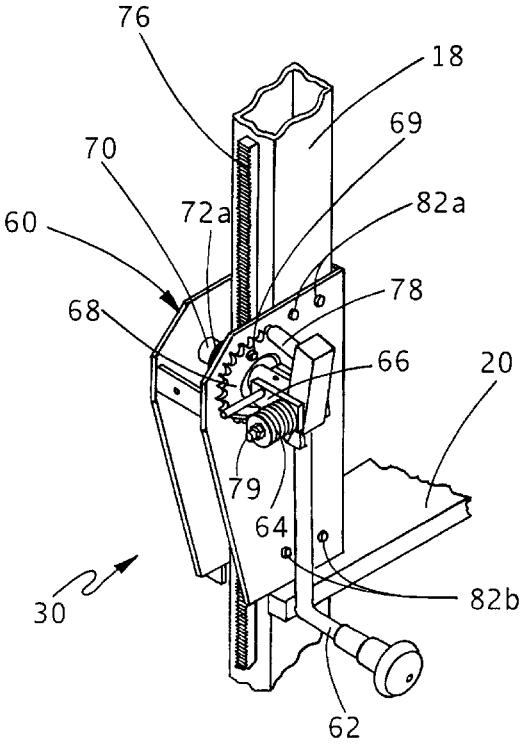
FIGS. 6*a* and 6*b* are perspective views of a film wrap height positioner for use in the package wrapping apparatus of the present invention respectively illustrating the film wrap height positioner in the unlocked and locked positions.
Figure 6B:
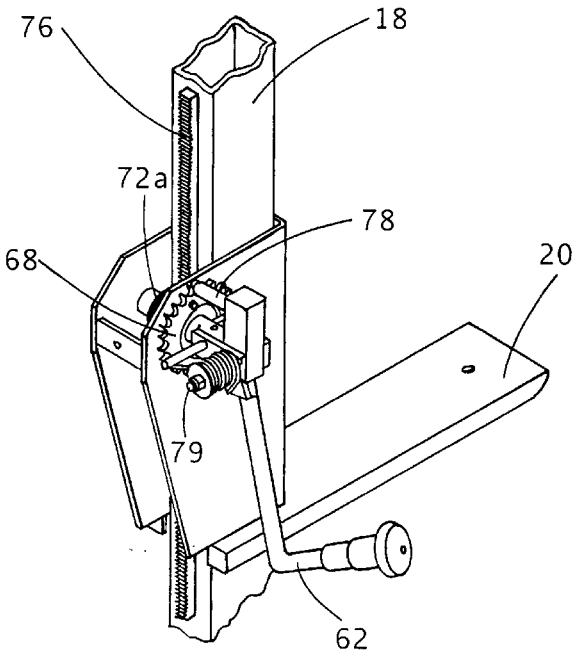

Referring to FIGS. 3 and 6*a*, 6*b*, the configuration and operation of the film wrap height positioner 30 and tensioner 22 will now be described. The film wrap height positioner 30 includes a film wrap carriage 60 disposed on the vertical support column 18. Disposed on one surface of the vertical support column 18 is a gear rack 76. Disposed on the film wrap carriage 60 is the combination of a crank 62, a torsion spring 64, a coupler 66, a sprocket 68, and a rotatable shaft 70. Shaft 70 extends between facing lateral portions of the film wrap carriage 60, with bushings and spacers 72 and a spur gear 72*a* disposed on shaft 70 between the facing lateral portions of the film wrap carriage 60. The spring-loaded crank 62 is coupled to shaft 70 by means of coupler 66. Rotation of crank 62 causes a corresponding rotation of shaft 70 and spur gear 72*a*. Thus, when crank 62 is rotated clockwise as viewed in FIG. 6*a*, the film wrap carriage 60 will be displaced upwardly along the vertical support column 18 because of the engagement of the rotating spur gear 72*a* with gear rack 76. Similarly, the rotation of crank 62 in a counter clockwise direction will result in a lowering of the film wrap carriage 60 along the vertical support column 18.

Sprocket 68 is fixedly attached to the film wrap carriage 60 by means of one or more coupling bolts 69. Extending from a proximal end of crank 62 is a lock pin 78. Crank 62 is free to pivot about a pivot pin 79 inserted through a distal end portion of coupler 66. With crank 62 displaced inwardly toward the film wrap carriage 60 as shown in FIG. 6*a*, lock pin 78 is displaced away from sprocket 68 and the combination of crank 62 and spur gear 72*a* is freely rotatable about the longitudinal axis of shaft 70 to allow for displacement of the film wrap carriage 70 along vertical support column 18. When crank 62 is pivotally displaced outwardly about pivot pin 79 as shown in FIG. 6*b*, the distal end of lock pin 78 is inserted between adjacent teeth within sprocket 68 to prevent rotation of the combination of crank 62, shaft 70 and spur gear 72*a* to prevent displacement of the film wrap carriage 60 on the vertical support column 18. Torsion spring 64 disposed about pivot pin 79 and engaging crank 62 urges the crank outwardly from the film wrap carriage 60 as shown in FIG. 6*b* to maintain lock pin 78 in engagement with sprocket 68. In this manner, the film wrap carriage 60 is maintained in the locked position to prevent movement of the film wrap carriage on the vertical support column 18 until crank 62 is urged inwardly to the position shown in FIG. 6*a* by overcoming the force of torsion spring 64. When crank 64 is displaced inwardly as shown in FIG. 6*a*, crank 62 may be rotationally displaced for moving the film wrap carriage 60 either up or down along the vertical support column 18. Polyethylene contact buttons 82*a* and 82*b* comprised of an ultra-high molecular weight material are inserted through the film wrap carriage 60 and engage opposing lateral surfaces of the vertical support column 18 to facilitate sliding displacement of the film wrap carriage along the vertical support column. A removable cover 74 is attached to the film wrap carriage 60 for covering the spur gear 72 as it engages gear rack 76 for safety reasons.

Attached to and extending from the film wrap carriage 60 is a support bracket 20. Support bracket 20 is securely coupled to the film wrap carriage 60 by conventional means such as weldments. Attached to a distal end of support bracket 20 is a film wrap supply and tensioner mechanism 22. The supply and tensioner mechanism 22 is adapted to support a film wrap roll 26 and includes upper and lower washers 28*a* and 28*b* and a roll support shaft 24 inserted through the film wrap roll. Support shaft 24 is also inserted through upper and lower washers 28*a*, 28*b* which are disposed on respective upper and lower ends of the film wrap roll 26. Disposed on the upper end of the support shaft 24 is a tension control knob 40 which allows for rotational displacement of the support shaft for adjusting the tension applied to the film wrap roll 26. In this manner, the extent to which the film wrap removed from roll 26 is stretched as it is wrapped around a rotating package may be precisely controlled by either tightening or loosening the roll support shaft 24.

Figure 7B:
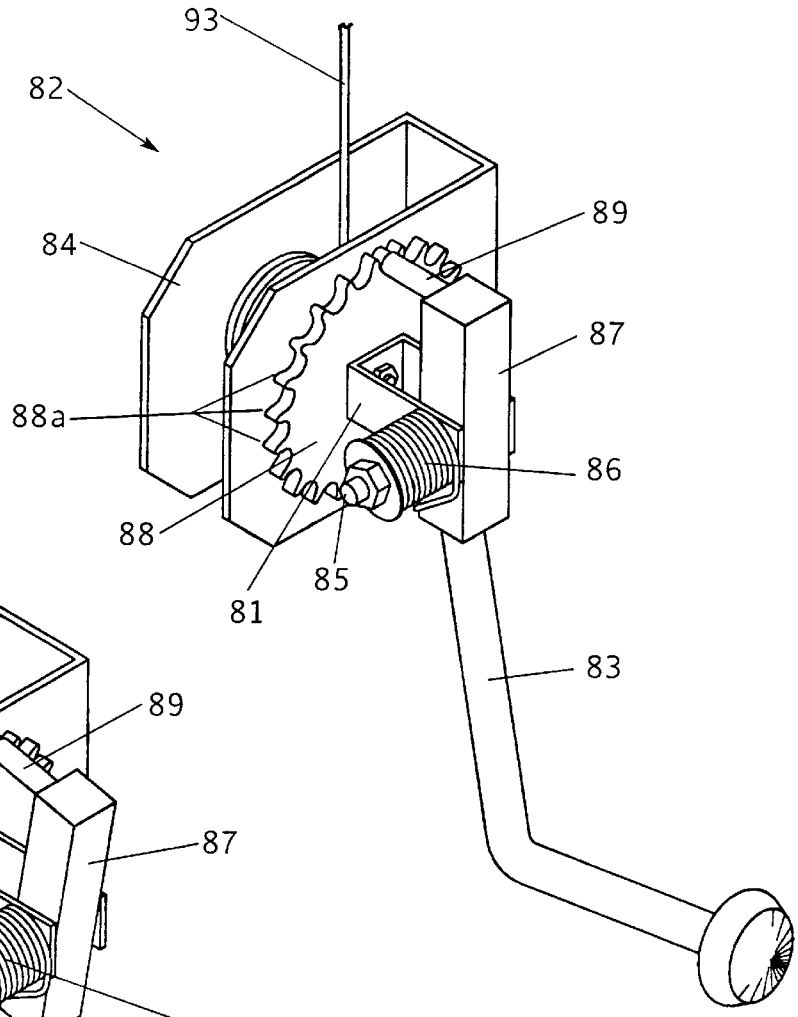
FIGS. 7*a* and 7*b* are perspective views of a winch with a locking mechanism shown respectively in the unlocked and locked configuration in accordance with the principles of the present inventions.
Figure 7A:
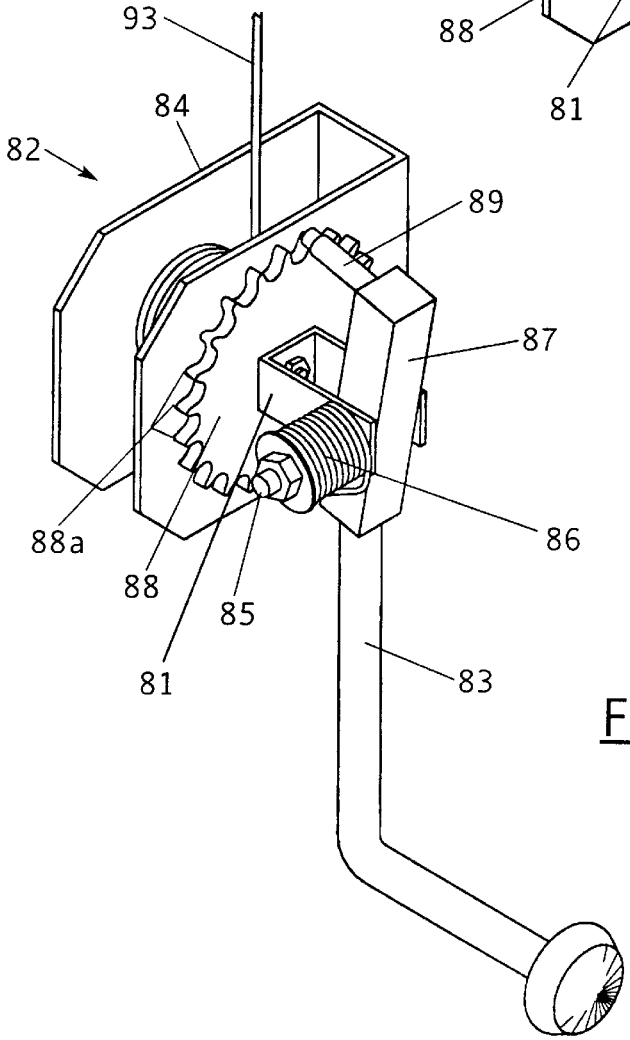
Figure 8A:
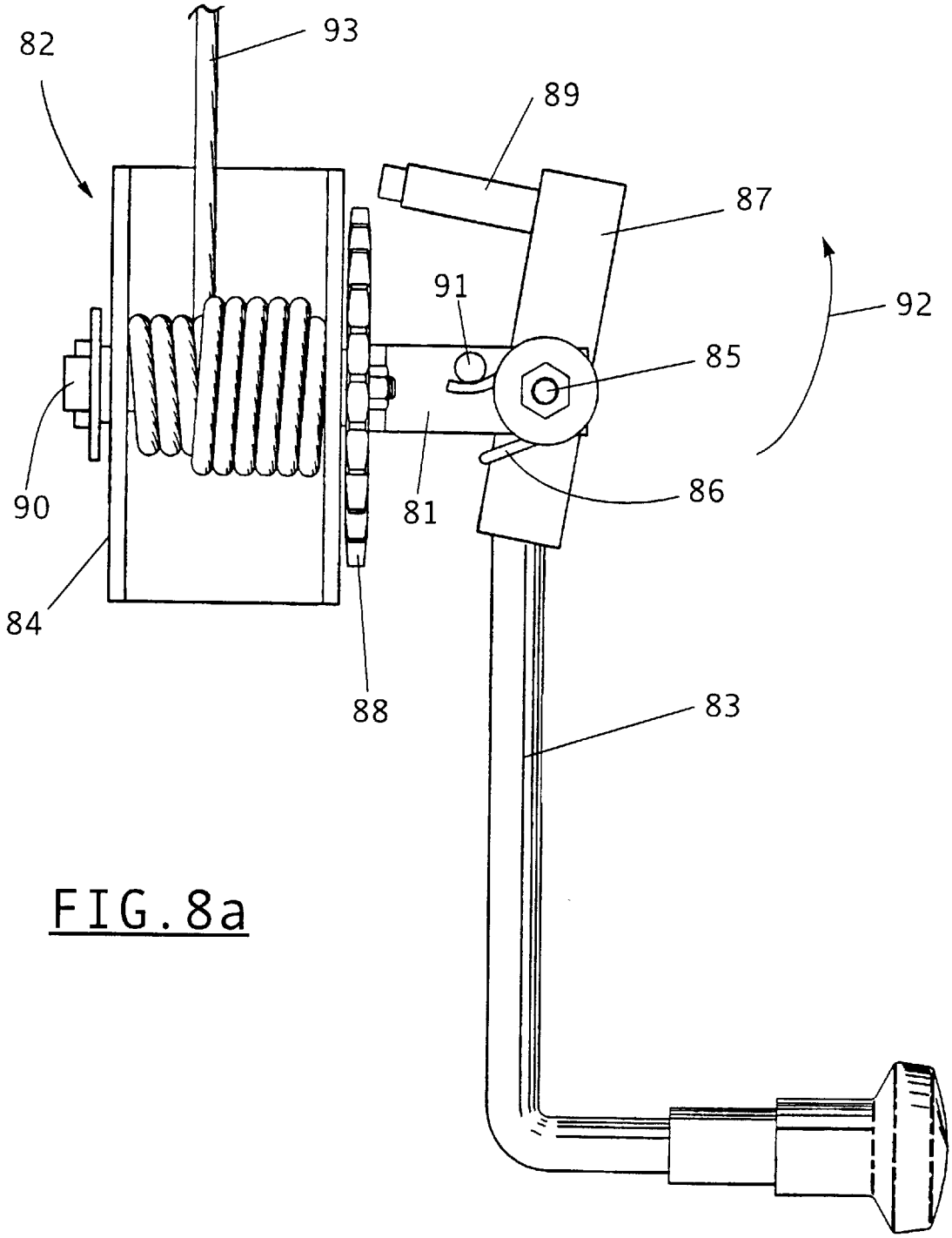
FIGS. 8*a* and 8*b* are front elevation views of the inventive winch with a locking mechanism shown respectively in the unlocked and locked configurations.
Figure 8B:
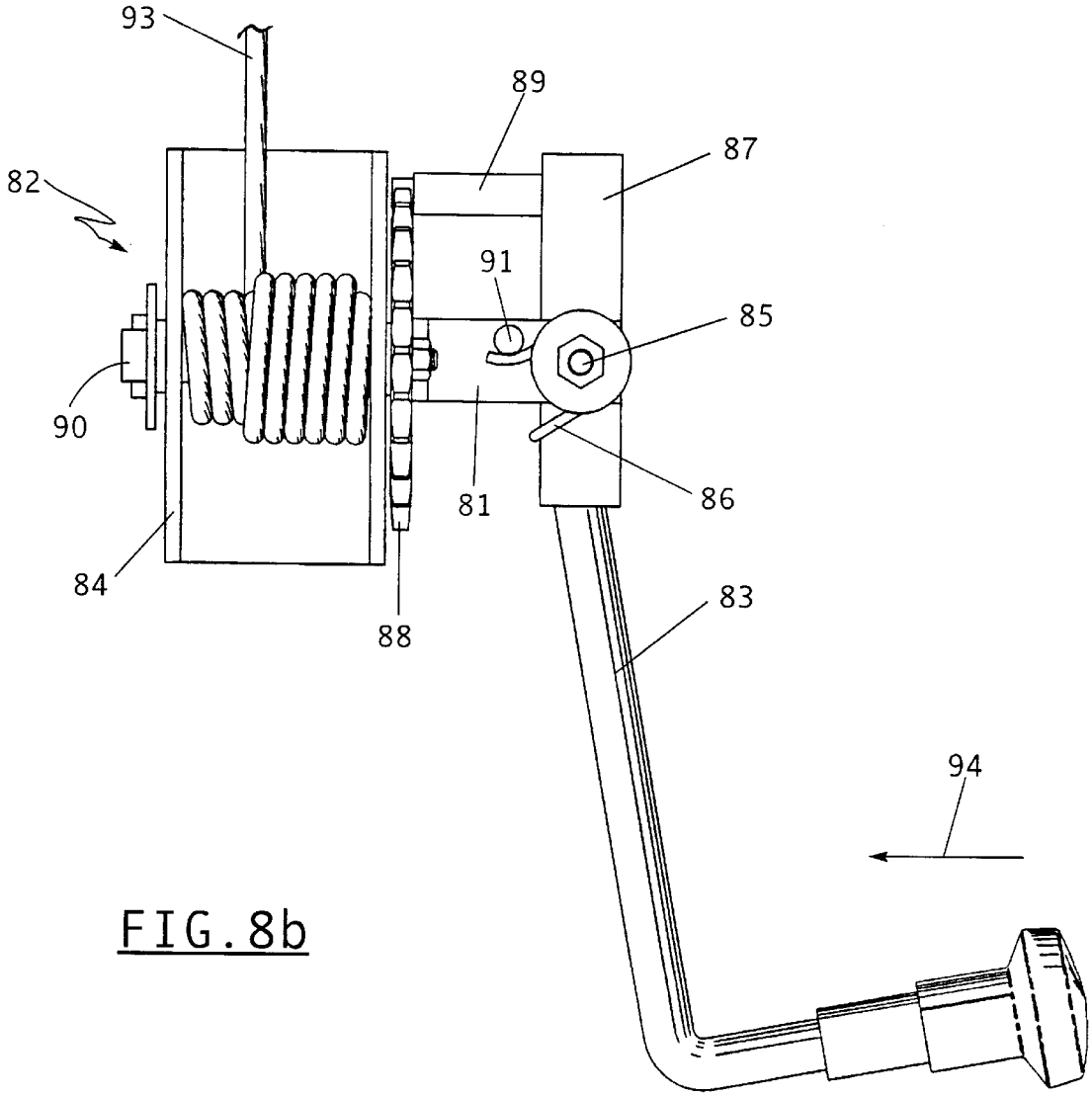
Figure 9:
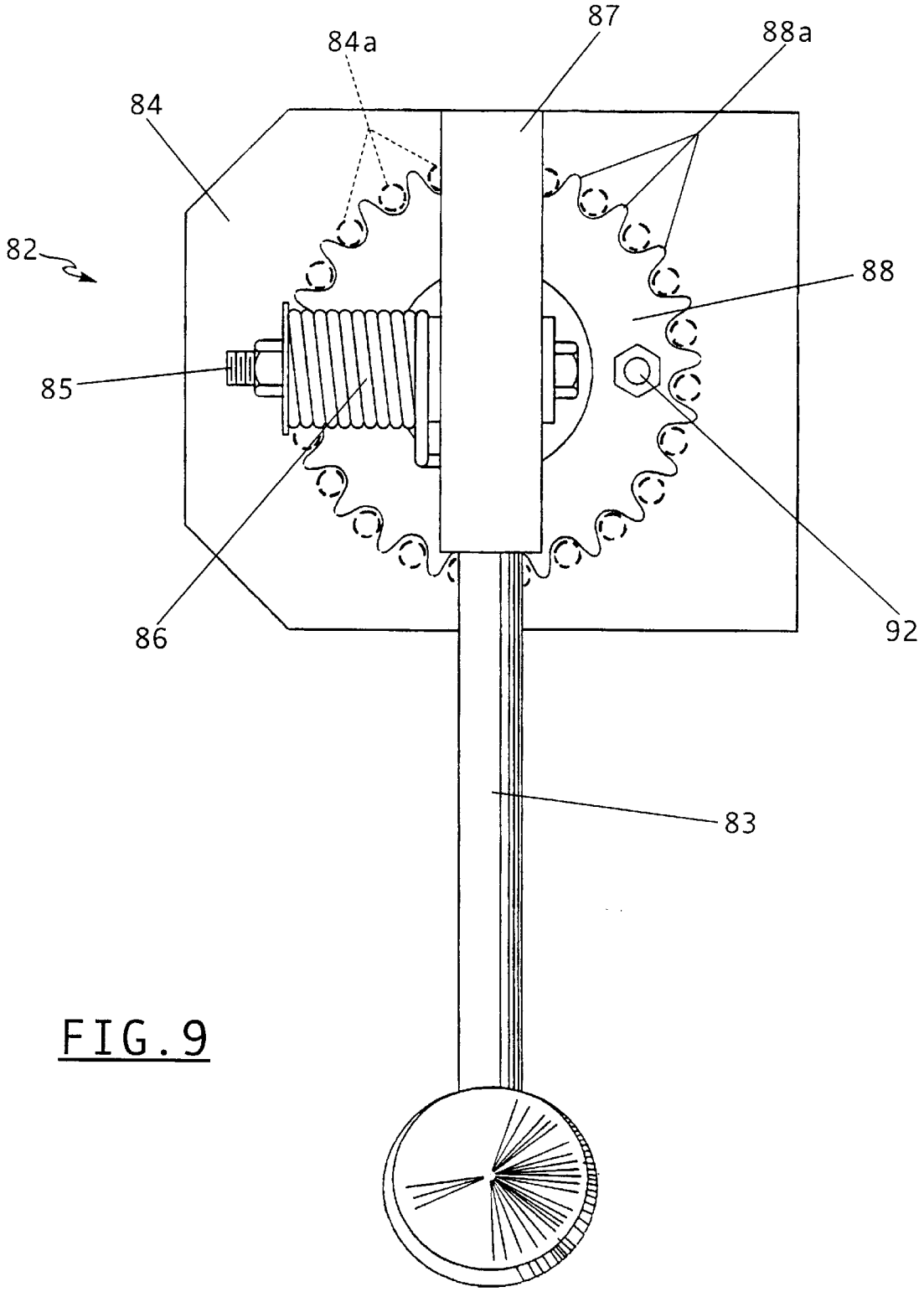
FIG. 9 is a side elevation view of the winch with locking mechanism of the present invention.

Referring to FIGS. 7*a* and 7*b*, there is shown a locking winch 82 in the unlocked and locked configuration, respectively, in accordance with the present invention. FIGS. 8*a* and 8*b* are front elevation views of locking mechanism 82 also shown respectively in the unlocked and locked configurations. Finally, FIG. 9 is a side elevation view of the locking winch 82 of the present invention.

Locking winch 82 includes a generally U-shaped mounting bracket 84 for attaching the winch to a support body such as a trailer, a truck, a hoist, or virtually any structure toward which it is desired to pull or lift a body using the inventive winch. One common application for which the locking winch 82 of the present invention is intended is on a boat trailer for pulling a boat onto and maintaining the boat securely in position on a trailer. The body or object to which the winch is mounted by means of bracket 84 is not shown for simplicity. Conventional means such as a nut and bolt combination or a clamp (also not shown) may be used to attach bracket 84 to a support structure.

Locking winch 82 further includes a rotating shaft 90 attached to opposed, spaced portions of mounting bracket 84. Wrapped around the rotating shaft 90 is a cable, rope or chain, herein referred to as a cable for simplicity. The rotation of shaft 90 in a first direction wraps the cable around the shaft, while rotation of the shaft in a second opposed direction allows the cable to be withdrawn from the shaft. Attached to an outer portion of mounting bracket 94 is a sprocket 88 having a plurality of spaced teeth 88*a* disposed about the periphery thereof. Sprocket 88 is fixedly attached to the outer portion of mounting bracket 84 by conventional means such as a nut and bolt combination 92 as shown in FIG. 9. Shaft 90 extends through fixed sprocket 88 and is freely rotatable in mounting bracket 84.

Extending outwardly from the end of shaft 90 is a coupler 81. Attached to a distal end portion of coupler 81 is a combination of a pivot lock 87 and a hand operated crank 83. Pivot lock 87 is securely connected to crank 83 to form a single, rigid structure. The combination of pivot lock 87 and crank 83 is pivotally coupled to a distal end of coupler 81 by means of a pivot pin 85. Pivot pin 85 extends through opposed distal portions of coupler 81 and further extends through pivot block 87. Disposed about pivot pin 85 is a torsion spring 86 with one of its ends engaging pivot block 87. A second end of the torsion spring 86 is in contact with a spring stop, or retainer pin, 91 disposed on coupler 81. Torsion spring 86 urges the combination of pivot block 87 and crank 83 in a counterclockwise direction in the direction of arrow 92 in FIG. 8*a*. Rotation of the pivot block 87 and crank 83 in this direction causes a lock pin 89 attached to the pivot block to be positioned between adjacent peripheral teeth 88*a* in the sprocket 88. This prevents rotation of the pivot block 87, crank 83 and coupler 81 combination and also prevents rotation of shaft 90. With the end of lock pin 89 disposed between adjacent teeth 88*a* in the periphery of sprocket 88, cable 93 is prevented from either being withdrawn from or wound onto shaft 90. Locking winch 82 is thus locked in a fixed configuration preventing any movement of cable 93. While the means for urging the crank assembly to the locked configuration is disclosed as a torsion spring 86, virtual any type of energy storage mechanism such as a compression spring could be employed to maintain winch 82 locked. In addition, while lock pin 89 is disclosed as engaged by the peripheral teeth 88*a* of fixed sprocket 88 for maintaining winch 82 locked, other arrangements could be employed equally as well for locking the winch. For example, a plurality of spaced apertures 84*a* arranged in a generally circular pattern as show in FIG. 9 in dotted line form may be used for receiving the crank's lock pin 89 for locking the crank in a selected position. In this latter arrangement, fixed sprocket 88 with its peripheral teeth 88*a* would not be necessary.

When the force exerted by torsion spring 86 on pivot block 87 is overcome by applying a force to crank 83 in the direction of arrow 94 in FIG. 8*b*, lock pin 89 is removed from contact with fixedly mounted sprocket 88 permitting the winch's shaft 90 to be rotationally displaced. With the combination of crank 83, pivot block 87 and lock pin 89 in the position shown in FIGS. 7*a* and 8*a*, cable 93 may be wound up on rotating shaft 90 or may be unwound from the shaft. When the desired length of cable 93 is either wound onto or unwound from shaft 90, crank 83 is released by the winch operator allowing rotational displacement under the influence of torsion spring 86 of the pivot block 87 and crank 83 combination permitting lock pin 89 to be positioned between and in contact with adjacent peripheral teeth in sprocket 88 for locking the winch and cable combination in a fixed position. Thus, by merely overcoming the force exerted on the pivot block 87 and crank 83 combination using only one hand with a single motion, winch 82 may be changed from the locked to the unlocked configuration, and visa versa, by an operator of the winch. Subsequent operation of the winch, i.e., winding or unwinding the cable, is then possible also using only one hand.

There has thus been shown a winch with a locking mechanism including a rotatable shaft coupled to a bracket which is adapted for connection to a fixed body or structure such as a trailer, truck, hoist, etc. Disposed about the shaft is a cable, with a hand operated crank connected to one end of the shaft for rotating the shaft in a first direction for winding the cable about the shaft or for rotating the shaft in a second, opposed direction for letting out the cable from the shaft. The crank is movable between first and second positions on the shaft. A fixed sprocket is mounted to the bracket adjacent the shaft and includes a plurality of spaced teeth disposed about the periphery thereof. A locking pin attached to the crank is positioned between adjacent teeth in the periphery of the sprocket when the crank is in the aforementioned first position to prevent rotation of the shaft and either withdrawal of the cable from or take-up of the cable. When the crank is manually moved to the aforementioned second position, the locking pin is removed from between adjacent teeth on the sprocket permitting rotation of the crank and shaft and allowing the cable to be either taken up on or removed from the shaft. A torsion spring urges the crank and locking pin to the aforementioned first position wherein the winch is locked preventing any movement of the cable. The biasing force of the torsion spring must be overcome to permit rotation of the crank and winch shaft and any movement of the cable. The crank automatically returns to the first position under the influence of the torsion spring when manual pressure is removed from the crank, returning the winch to the locked configuration.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A locking winch comprising:

a bracket;

a rotatable shaft coupled to said bracket and having a cable, rope or chain disposed thereabout;

a hand operated crank coupled to said shaft for rotating said shaft in a first direction for retracting said cable, rope or chain about said shaft or for rotating said shaft in a second, opposed direction for removing said cable, rope or chain from said shaft, wherein said crank is moveable between first and second positions on said shaft;

biasing means for urging said crank to said first position;

stop means mounted to said bracket for providing a plurality of stop members disposed about the periphery thereof; and locking means attached to said crank for engaging a stop member when said crank is in said first position for preventing rotation of said crank and shaft and removal of said cable, rope or chain from said shaft, wherein said locking means disengages said stop member when a force exerted by said biasing means on said crank is overcome and said crank is moved to said second position allowing the cable, rope or chain to be wound onto or removed from said shaft.

2. The locking winch of claim 1 wherein said first position of said crank is farther from said bracket than said second position, requiring said crank to be displaced inwardly toward said bracket to disengage said locking means from said stop member for rotating said shaft for either winding said cable onto or removing said cable from said rotatable shaft.

3. The locking winch of claim 2 further comprising a pivot pin and coupler combination for connecting said crank to said rotatable shaft, wherein said crank is connected to said pivot pin for pivoting between said first and second positions.

4. The locking winch of claim 3 wherein said crank and said locking means are on opposed sides of said pivot pin.

5. The locking winch of claim 4 wherein said biasing means is mounted to said pivot pin for urging said crank and said locking means in a first direction of rotation about said pivot pin toward said first position.

6. The locking winch of claim 5 wherein said biasing means comprises a spring.

7. The locking winch of claim 1 wherein said stop means comprises a sprocket fixedly mounted to said bracket and including a plurality of spaced teeth about the periphery thereof forming said stop members.

8. The locking winch of claim 7 wherein said locking means comprises a pin attached to an end of said crank for engaging a tooth of said fixed sprocket when said crank is in said first position.

9. The locking winch of claim 1 wherein said stop means comprises a plurality of spaced apertures in said bracket arranged in a generally circular pattern forming said stop members and adapted to receive said locking means.

10. The locking winch of claim 9 wherein said locking means comprises a pin attached to an end of said crank for insertion in an aperture in said bracket when said crank is in said first position.

* * * * *